US006619905B2

(12) United States Patent
Stahler

(10) Patent No.: US 6,619,905 B2
(45) Date of Patent: Sep. 16, 2003

(54) DRUM HANDLING DEVICE

(75) Inventor: Richard D. Stahler, Mantua, NJ (US)

(73) Assignee: Wesco Industrial Products, Inc., Lansdale, PA (US)

( * ) Notice: Subject to any disclaimer, the term of this patent is extended or adjusted under 35 U.S.C. 154(b) by 37 days.

(21) Appl. No.: 09/879,221

(22) Filed: Jun. 12, 2001

(65) Prior Publication Data

US 2002/0187033 A1 Dec. 12, 2002

(51) Int. Cl.[7] ..... B66F 9/18
(52) U.S. Cl. ..... 414/622; 414/621
(58) Field of Search ..... 414/621, 622; 294/106

(56) References Cited

U.S. PATENT DOCUMENTS

| | | | | |
|---|---|---|---|---|
| 2,635,775 A | * | 4/1953 | Ernst | 414/621 |
| 2,698,107 A | * | 12/1954 | Ericson | 414/621 |
| 2,987,204 A | * | 6/1961 | Wallace | 414/621 |
| 3,760,964 A | | 9/1973 | Trapp | |
| 4,130,212 A | * | 12/1978 | Gatilao | 414/653 |
| 4,239,443 A | * | 12/1980 | Rysewyk | 414/618 |
| 4,243,354 A | | 1/1981 | Garcia | |
| 4,318,661 A | | 3/1982 | Helm | |
| 4,385,860 A | | 5/1983 | Corbin | |
| 4,741,659 A | * | 5/1988 | Berg | 414/622 X |
| 5,618,154 A | | 4/1997 | Irons et al. | |

FOREIGN PATENT DOCUMENTS

| | | | | |
|---|---|---|---|---|
| GB | 893998 | * | 4/1962 | |
| GB | 2248222 | * | 4/1992 | 414/662 |

OTHER PUBLICATIONS

Wesco Industrial Products, Inc., DM–1100 Ergonomic Drum Handler, Product Literature.

Easy Lift Equipment Co., Inc., Easy Lift Ergonomic Drum Transporter, Product Literature.

Liftomatic, Material Handling, Inc., Lift O Matic, Drum Handling Forklift Attachments, Product Literature.

Morse Manufacturing Company, Inc., Morspeed288 Series Drum Handling Fork–Lift Attachment, Product Literature, Dated 1999.

Morse Manufacturing Company, Inc., Morspeed288 Series Drum Handling Fork–Lift Attachment, Product Literature, Dated 2000.

* cited by examiner

*Primary Examiner*—Steven A. Bratlie
(74) *Attorney, Agent, or Firm*—Frank J. Bonini, Jr.; Harding, Earley, Follmer & Frailey

(57) ABSTRACT

A device for handling containers, such as drums, is provided to facilitate holding a drum during drum handling by engaging the drum with a first clamping member and a second clamping member which can be selectively locked with a locking mechanism to facilitate the secure holding of the drum during handling by facilitating the maintenance of the drum in clamped engagement with the device.

15 Claims, 8 Drawing Sheets

DRUM HANDLING DEVICE

BACKGROUND OF THE INVENTION

1. Field of Invention

The present invention relates generally to the field of drum handling equipment, and more particularly to an apparatus for holding, lifting and transporting drums.

2. Brief Description of the Related Art

A variety of devices are known for transporting individual containers, barrels, drums or the like (hereinafter referred to only as drums) from one location to another. Among these devices are apparatus for lifting and handling drums. The drums themselves generally, for example, can comprise steel, poly or fiber. Generally, drums have a rimmed, open end which is sealed with a lid. The drum lid itself may have one or more sealable openings to permit selective delivery of the drum contents through the opening without removal of the entire drum lid.

Turning to types of lifting and transporting apparatus, in one type, the drum is engaged on its sides by a pair of pincers and is held by virtue of a squeezing action. In another type of apparatus, the drum is lifted from beneath. And in yet another type of apparatus, the drum is lifted and transported with a device which engages the drum by clamping the lip of the drum. Generally, the latter type of such devices are actuated by weight, so that when the drum weight is exerting a force on the device, the device remains clamped. Likewise, when the drum weight is absent, such as for example, when the drum is resting on a surface, the clamp disengages the drum lip, and the drum is freed from the apparatus. While this type of device is generally useful when the drum is resting on a floor, there are times when the device may sense that the drum is "weightless" (i.e., not exerting a force), such as, for example, during a momentary weight shift, turbulence encounter or when bumped. This false weightlessness can be problematic. The consequences, for example, can lead to the clamping device becoming disengaged, as it senses no weight from the drum, when in fact, the apparatus has been moved over a bumpy surface, and where the weightlessness is not due to the drum being secured on a surface. It is common in the industry to stack drums for shipping and storage in order to maximize the utilization of plant or packaging space. Often times, the drums are stacked in an array, or on a pallet using a lifting device, such as a forklift type truck. The drums are typically picked up by the forklift which can transport the drums from one location, such as a loading dock, to another location, such as on the top of a stack of drums in a warehouse or plant. A drum holding device can be employed in conjunction with a transport vehicle, such as a forklift, which can move the drum holding device and drum carried thereby. In the transport of the drum, the forklift or other transport vehicle may travel along a surface. During travel, the transport vehicle is subject to the terrain over which it moves, and it is not uncommon for bumps to be encountered, whether due to uneven surfaces, ramps, or merely inadvertent debris or material left in the path of travel. When the transport vehicle, such as a forklift, is jarred, the drum holding device can become disengaged from the drum, thereby resulting in an unsafe condition, where the drum is no longer under the control of the operator. As a result, the drum can drop, roll, or otherwise move in an uncontrollable manner. When this occurs, there is great risk posed to individuals who are nearby. Even the weight of an empty drum, whether steel, poly or fiber, can be substantial, and can severely injure an individual if it drops on them. In addition, a drum can break, or the top become dislodged, thereby causing the contents of the drum to escape and spill into the plant or work area. In addition to wasting time and resources with clean up which must follow, depending on the contents being stored in or carried by the drum, there may be a danger of exposing individuals to a harmful substance. The drums must be transported in a reasonably efficient time frame to permit the safe transport of the drum and its contents, while at the same time enabling the drums to be readily secured and released from a holding device.

While it is important to secure the drums, cumbersome mechanisms which take time to attach and disengage, eat into operating efficiencies and may make it economically unfeasible for a company to produce a product. In addition, even using the greatest degree of care, with the prior art type lifting and handling apparatus, there is a potential risk of inadvertently dropping a drum from the device. A need exists for a device which, on one hand, can minimize the inadvertent release of a drum and the risks associated therewith when the drum is being lifted, moved or otherwise handled, yet, on the other hand, also can provide ease of operation and efficiencies.

SUMMARY OF THE INVENTION

A device for handling containers, such as drums, is provided. The device is operated to selectively engage a drum to hold the drum so that the drum can be lifted or moved. The device has a locking mechanism which selectively locks the device in an engaging relation with a drum to facilitate handling of the drum. The locking mechanism of the device can be released to permit disengagement of a drum.

An object of the present invention is to provide a device for handling drums which has improved securing ability and minimizes the potential for inadvertent releasing of drums during handling.

Another object of the present invention is to provide an improved drum handling device which can be used with manually operated moving, lifting, and transporting apparatus.

Another object of the present invention is to provide an improved lifting and handling device which has application and use with a forklift type truck.

Another object of the present invention is to provide a novel drum handling device which has a selectively releasable locking mechanism to facilitate secure holding of a drum.

Another object of the present invention is to provide a novel drum handling device which can be used for holding and lifting a drum.

Another object present invention is to provide a novel drum handling device which can transport a drum held by the drum handling device from one location to another location.

Another object of the present invention is to provide a novel drum handling device for facilitating the handling of drums thereby, including the lifting, holding and transport of drums.

Another object of the present invention is to provide a novel drum handling device which can be mounted on the carriage of a lift, such as for example, a fork lift type truck or vehicle.

Another object of the present invention is to provide a novel drum handling device which can be carried on the forks of a fork lift type truck or vehicle.

Another object of the present invention is to provide a novel device for facilitating the stacking of drums.

BRIEF DESCRIPTION OF THE DRAWING FIGURES

FIG. 1 is front elevation view of a drum handling device constructed in accordance with the present invention, the device being displayed in an open position.

FIG. 2*a* is a front elevation view of the housing of the drum handling device of FIG. 1, shown separately.

FIG. 2*b* is an enlarged rear elevation view showing the hook with the locking pins being carried in the hook body portion, which shown in sectional view.

DETAILED DESCRIPTION OF THE PREFERRED EMBODIMENTS

Figure 1:
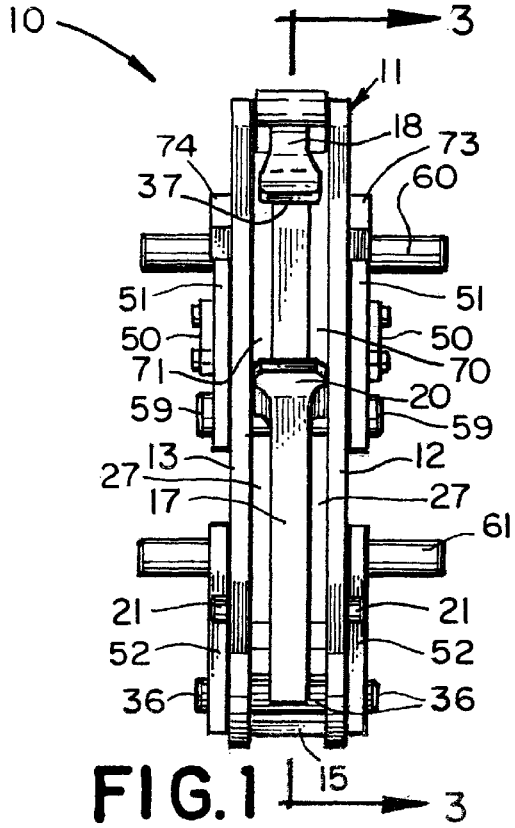
Figure 2A:
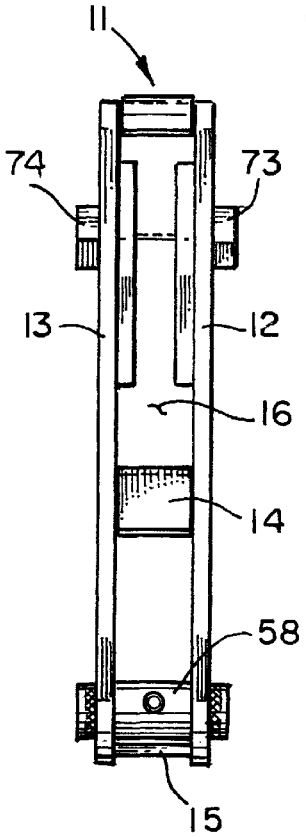
Figure 2B:
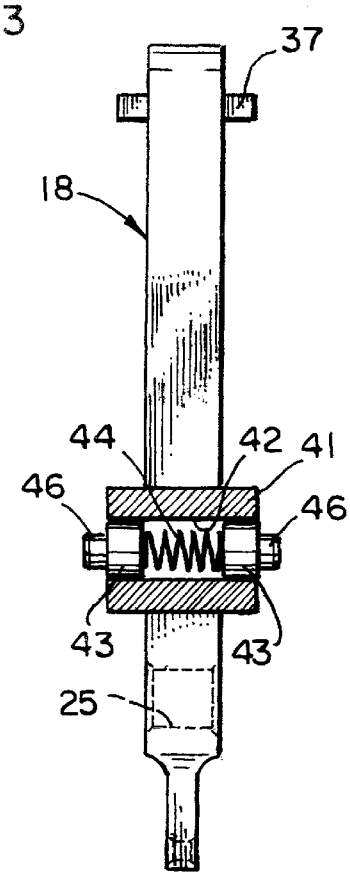

Reference now being made to the drawing figures, there is illustrated in FIG. 1 a preferred embodiment of a drum handling device 10, constructed in accordance with the present invention. The drum handling device 10 is used for holding a container, such as, for example, the drum 110 illustrated in FIG. 5. The drum handling device 10 comprises a housing 11 having a first side wall 12 and a second side wall 13 which are oppositely disposed and spaced apart from each other to define a housing space 16 therebetween (FIG. 2). The first side wall 12 and second side wall 13 are held together with connecting means. The connecting means can comprise suitable connecting elements, such as, for example, bolts, spacers, rods, wall portions, or other suitable members which may be separately or integrally provided. In accordance with a preferred embodiment of the invention, as shown in FIGS. 1 and 2*a*, the housing 11 has first and second connecting wall portions 14 and 15, respectively, which are disposed to span transversely between the first side wall 12 and the second side wall 13. The first and second connecting wall portions 14, 15 space the first side wall 12 from the second side wall 13.

Figure 3:
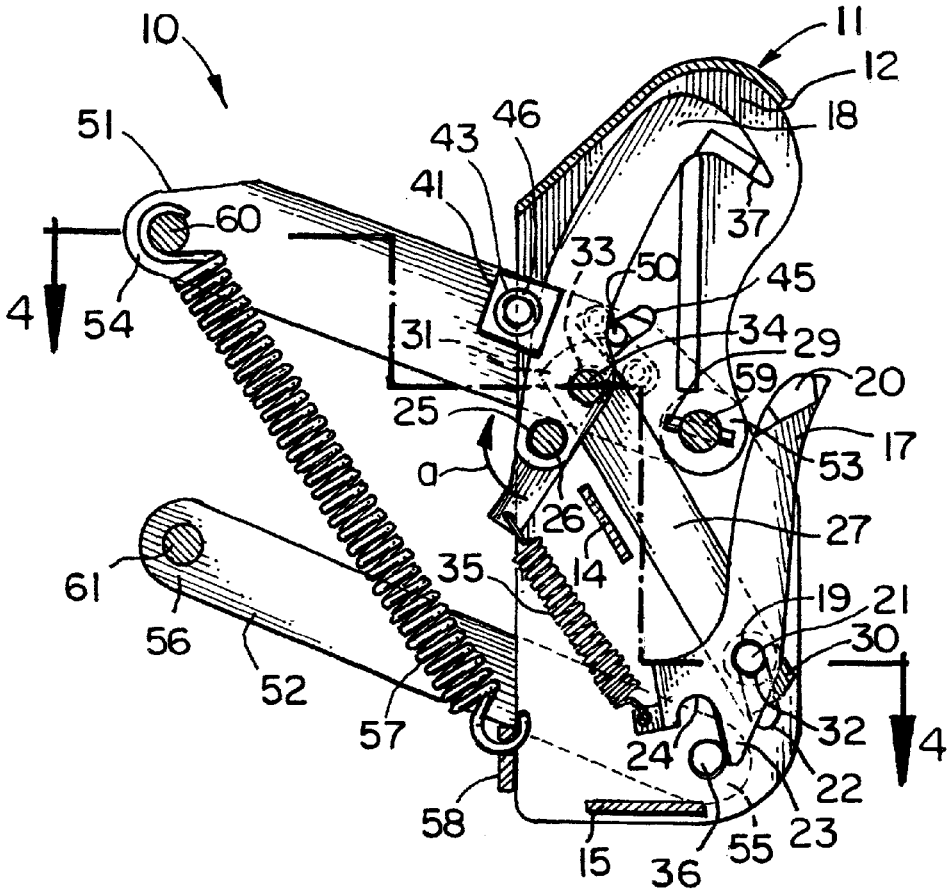
FIG. 3 is a left side sectional view of the drum handling device shown in FIG. 1 taken along the section line 3—3 of FIG. 1 showing the device in an open position, exposing the interior of the housing and components.
Figure 5:
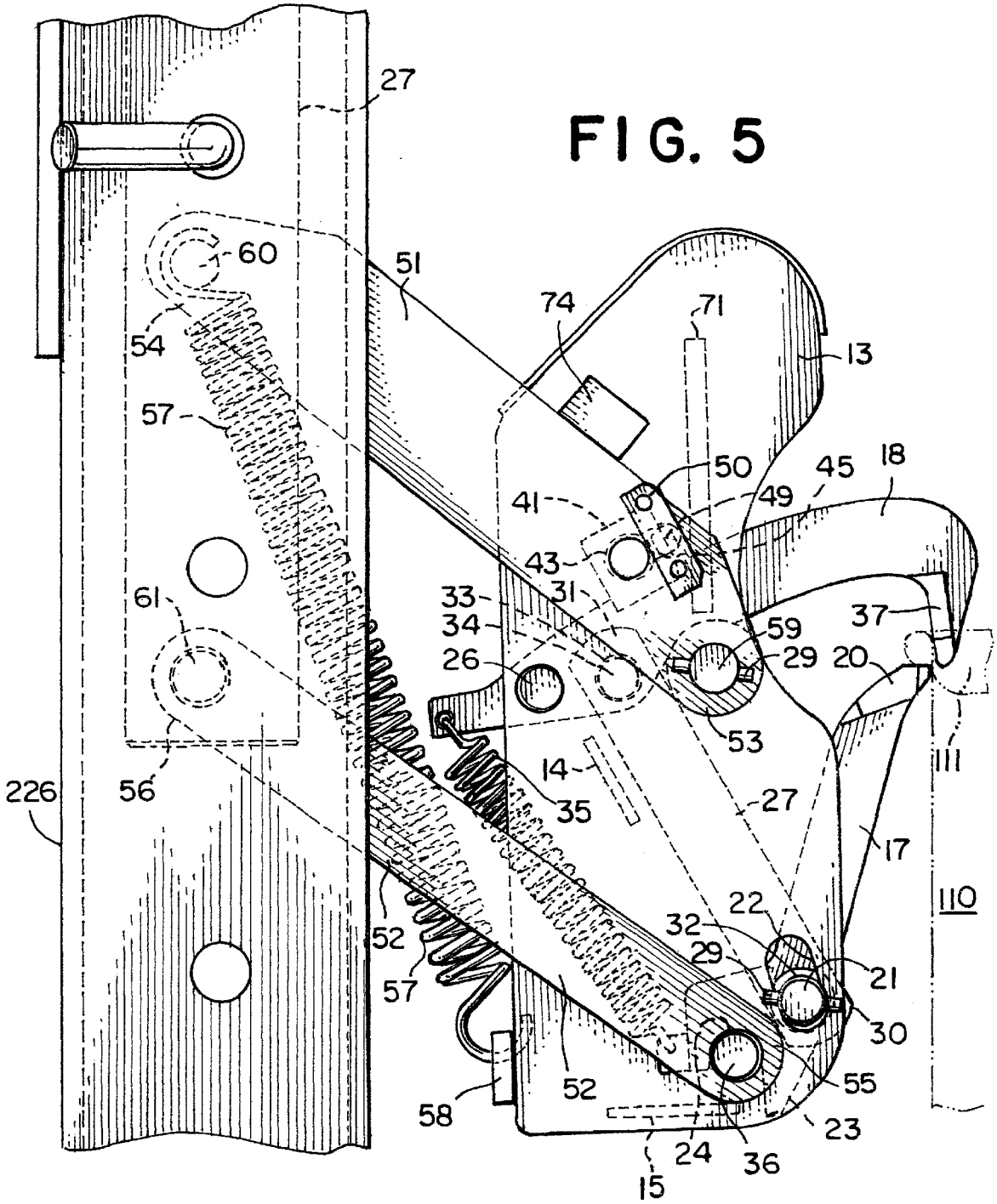
FIG. 5 is a left side elevation view of the drum handling device shown in FIGS. 1–4, displayed in a clamping position engaging a drum shown in phantom, and illustrated with a load supporting apparatus shown in partial view.

The drum handling device 10 further comprises clamping means for clamping the device 10 on a rim 111 of a drum 110. In accordance with a preferred embodiment of the present invention, as best illustrated in FIGS. 3 and 5, the clamping means comprises a first clamping member comprising a pawl 17 and a second clamping member comprising a hook 18. The pawl 17 and hook 18 are carried on the housing 11 and are disposed to clamp the rim 111 of a drum 110, as illustrated in FIG. 5 where the pawl 17 and hook 18 are in clamping engagement with a drum 110. The pawl 17 preferably has a flange 20 for facilitating engagement of a drum 110, and in particular the drum rim 111. The pawl 17 is pivotally mounted on the housing 11 with a pawl mounting pin 21. The pawl mounting pin 21 spans transversely from the first side wall 12, through a bore 19 formed in the pawl 17, and to the second side wall 13, and secures the pawl 17 to the housing 11. As best illustrated in FIGS. 1 and 5, the pawl mounting pin 21 can pass through the housing first and second side walls 12, 13 and be secured at each end thereof with a retaining member 29 to hold the pin 21 on the housing 11.

Referring again to FIG. 3, the housing 11 has a first cam slot 22 formed in the housing first side wall 12, there being another first cam slot 22 formed in the second side wall 13 located opposite of the first wall first cam slot 22 (FIG. 5). The pawl 17 is pivotally mounted on the housing 11 for translational movement over a predetermined range. The range of translation is defined by the travel of the pawl mounting pin 21 within the first cam slot 22 between an open position, shown in FIG. 3, to an engaged or clamping position, shown in FIG. 5. The pawl 17 is pivotally mounted on the housing 11 and is depressible inwardly relative to said housing 11 by its ability to pivot. The ability of the pawl 17 to depress facilitates positioning of the pawl flange 20 below the rim 111 of a drum 110 to engage the drum 110 for clamping. The pawl 17 further has a foot 23 and a recess 24 formed near the foot 23. The foot 23 engages the jaw link pin 36 which provides a stop to limit further pivoting of the pawl 17. The pawl recess 24 facilitates seating of the pawl 17 on the jaw link pin 36 when the device 10 is in the clamping position, as shown in FIG. 5.

The hook 18 has a pivot bore 25 disposed transversely therethrough for facilitating the pivotal mounting of the hook 18 on the housing 11. Referring again to FIGS. 3 and 5, a hook pivot pin 26 extends transversely between the housing 11 from the first side wall 12, through the hook pivot bore 25, and to second side wall 13. The hook pivot pin 26 is secured at its ends to the housing first and second side walls 12, 13, respectively, with a suitable securing means, such as, for example, a fastening member.

The device 10 comprises clamping member linking means for linking the pawl 17 with the hook 18. In accordance with a preferred embodiment of the present invention, the clamping member linking means comprises a pair of linking members 27 which link the pawl 17 with the hook 18. Each linking member 27 has a pawl linking end 30 and a hook linking end 31. The pawl linking end 30 has a first bore 32 therethrough through which the pawl mounting pin 21 passes to pivotally secure the pawl 17 and linking members 27 on the housing 11. The pawl 17 is mounted to pivot relative to the linking members 27.

A second bore 33 is provided at the hook end 25 of each linking member 27. The linking members 27 are connected to the hook 18 with a hook linking pin 34. In the preferred embodiment shown in FIGS. 3 and 5, the hook linking pin 34 is fixedly connected to the hook 18 and is pivotally connected to the linking members 27 so that the hook 18 can pivot relative to the linking members 27. When the pawl 17 encounters the resistance of a drum by engaging a drum rim, the lifting of the device 10 translates the pawl 17 and the pawl mounting pin 21 along the first cam slot 22, from a first position shown in FIG. 3 where the device 10 is not clamped, to a second position shown in FIG. 5 where the device 10 is clamped on a drum 110. The linking members 27 translate with the pawl 17, and through their linkage with the hook 18 cause the hook 18 to pivot about the hook pivot pin 26.

Figure 4:
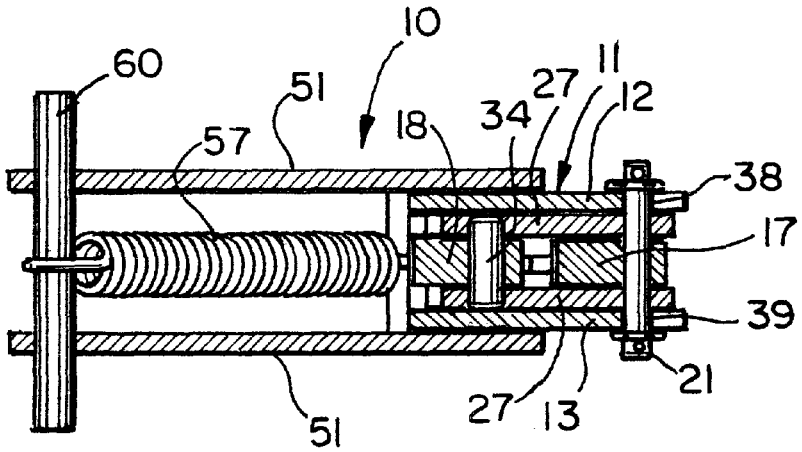
FIG. 4 is a sectional view of the drum handling device taken along the section line 4—4 of FIG. 3, and viewed looking at the top of the device.

Biasing means, such as the first extension spring 35, connects with the pawl 17 and the hook 18 to provide a biasing force to bias the pawl 17 and hook 18 into an open position to receive a drum 110, as shown by the position illustrated in FIG. 3. The first extension spring 35 biases the pawl 17 to a position where the pawl foot 23 engages the jaw link pin 36. The jaw link pin 36, as shown in FIG. 4, passes through oppositely disposed bores 38, 39 formed in the housing first side wall 12 and second side wall 13, respectively, and links a pair of lower frame links 52 with the housing 11. The first extension spring 35 biases the hook 18 inwardly, and preferably to a position where hook end 37 is retracted within the housing 11 to a rest position. In the rest position, the hook 18 remains free of interference with a drum which is to be handled by the device 10 until the pawl 17 is actuated by engagement with a rim 111 of a drum 110. The jaw link pin 36 provides a stop to control the outward extension of the pawl 17 relative to the housing 11 by limiting the pivot arc of the pawl 17.

The pawl 17 is pivotally carried on the pawl mounting pin 21 to facilitate clamping on a drum 110 so that when a drum 110 is to be engaged with the device 10, the pawl 17 can be moved inwardly in relation to the housing 11 to permit the pawl flange 20 to be cammed over a drum rim 111. This is particularly advantageous when the drum 110 is to be engaged by lowering the housing 11 from above the drum rim 111.

When the drum 110 is engaged from below the drum rim 111, the bias of the pawl 17 presents the pawl flange 20 outwardly from the housing 11 to facilitate engagement with a drum rim 111, as shown in FIG. 5, where the drum handling device 10 is in clamping engagement with a drum 110.

The hook 18 is pivotally mounted on the housing 11 as described above. The hook flange 37 facilitates holding the drum 110. Preferably, as shown in FIG. 5, the pawl 17 and hook 18 are moved together against the weight of the drum 110 so that the pawl 17 and hook 18 are in clamping engagement with the drum 110, and preferably engage the drum rim 111. The clamping of the pawl 17 and hook 18 commences when the pawl flange 20 engages the drum rim 111. The pawl flange 20 rests under the rim 111 and the device 10 is lifted relative to the drum 110. The further lifting of the housing 111 causes the pawl 17 to be drawn lower, with the pawl mounting pin 21 being driven lower in the first cam slot 22. As the pawl mounting pin 21 is driven lower in the first cam slot 22, the linking members 27 are translated to a lower position relative to the housing 11. The translation of the linking members 27 pivots the hook 18 forward in the direction of arrow "a" of FIG. 3 to a position where the hook 18 engages the rim 111 of the drum 110 (FIG. 5). Further lifting of the device 10 after clamping has occurred lifts the housing 11 and components to raise the drum 110.

Locking means is provided for facilitating selective locking of the first clamping member, such as the pawl 17, and second clamping member, such as the hook 18, in engagement with a drum 110, and in particular with the drum rim 111. The locking means is shown constructed in accordance with a preferred embodiment of the present invention comprising a locking element including a pair of locking pins 43 and a compression spring 44, as shown best in FIG. 2*b*. The hook 18 has a body portion 41 which is located between the housing first side wall 12 and the housing second side wall 13. The body portion 41 has a transverse receiving bore 42 for accommodating the locking pins 43. The compression spring 44 biases the pins 43 to protrude outwardly from the hook body portion 41. Locking cam slots 45 are formed in each of the housing first and second side walls 12, 13. The first side wall 12 and the second side wall 13 of the housing 11 are engaged by the locking pins 43 to force the locking pins 43 into recession within the transverse receiving bore 42 of the hook 18. When the hook 18 is rotated about its pivot axis defined by the hook pivot pin 26 to reach a predetermined position along the hook pivot arc, the locking pins 43 align with the locking cam slots 45, and are biased by the compression spring 44 to extend outwardly into the locking cam slots 45. The hook 18 is selectively locked against further movement, and remains in a clamping engagement with a drum 110, as shown in FIG. 5. Preferably, as shown in FIG. 3, each locking pin 43 has a chamfered edge portion 46 which facilitates the camming of the locking pin 43 into a locking cam slot 45 when the hook 18 is pivoted into engagement with a drum. The chamfered edge portion 46 of the locking pins 43 may also facilitate the retraction of the locking pins 43 from the cam slot 45 when the hook 18 is selectively released from engagement with a drum 110.

The locking means further comprises a release cam 50 to facilitate the release of the locking pins 43. A release cam 50 is mounted on each of the upper frame links 51, as best illustrated in FIGS. 1, 3 and 5. In accordance with a preferred embodiment of the present invention, the release cams 50 facilitate the selective release of the locking pins 43 from the locking cam slots 45. The housing 11 is preferably supported on a frame or other load supporting member and is connected to a frame or other load supporting member with linking means.

Linking means for linking the housing 11 with a frame or other load supporting member is shown comprising a pair of upper frame links 51 and lower frame links 52. Each upper frame link 51 has a housing link end 53 and a frame link end 54. Each lower frame link 52 has a housing link end 55 and a frame link end 56. A second extension spring 57 has a first end which is connected to a spring shelf 58 of the housing 11 and a second end which is connected to a first connecting member 60. The first connecting member 60 joins the pair of upper frame links 51 at the frame link ends 54. A second connecting member 61 joins the pair of lower frame links 52 at the frame link ends 56. The housing link end 53 of each upper frame link 51 is pivotally connected to the housing 11 with a mounting member, such as, for example, the mounting pin 59, which is secured with a fastening member 29. The first and second connecting members 60 and 61, respectively, can be connected to a frame or lifting mechanism to facilitate moving and or lifting of a drum (see e.g. FIGS. 6–12).

A release cam 50 is mounted on each upper frame link 51 and moves therewith. Preferably, the release cam 50 comprises a member which, as shown in FIG. 3, has a post 49 which protrudes into the locking cam slot 45 to selectively interfere with the locking element or pin 43. The selective interference of the release cam 50 is controlled by the operation of the device 10. When the pawl 17 and hook 18 are clamped to engage a drum 110, the locking pins 43 align with a locking cam slot 45 and are biased to protrude into the locking cam slot 45. The positioning of each of the locking pins 43 into a cam slot 45 locks the hook 18 into the clamping position (FIG. 5). The hook 18 and pawl 17 are released from engagement when a selective force is applied to force the pivoting of the upper frame link 51 to its lowered position (the position illustrated in FIG. 3). The force required to release the locking pins 43 must be sufficient to overcome the biasing force holding the locking pins 43 in the cam slots 45. The movement of the upper frame links 51 from a raised position (the position illustrated in FIG. 5) to a lowered position (FIG. 3) moves the release cams 50 carried thereby to engage the locking pins 43 and force the locking pins 43 inwardly within the hook body 41 so that the hook 18 is returned to its unclamped or rest position (the position illustrated in FIG. 3). Referring to FIGS. 1 and 2*a*, the housing 11 preferably comprises guide members 70, 71 for facilitating the guiding of the hook 18 during the clamping and releasing operations.

The lower frame links 52 are pivotally connected to the housing 11 with the lower jaw link pin 36, as shown in FIGS. 1 and 3. Upper frame link stops 73, 74 are provided on the housing 11 to limit a range of movement of the upper frame links 51. The spring shelf 58 is disposed at the lower portion of the housing 11 and secures an end of the second extension spring 57, as shown in FIG. 3, and extends outwardly from each the first side wall 12 and the second side wall 13 of the housing 11 to form a stop to limit the range of movement of the lower frame links 52 (FIG. 2*a*). In addition, the hook pivot pin 26 preferably can be provided to protrude outwardly from each side of the housing 11 to provide a stop for the upper frame links 51.

Figure 6:
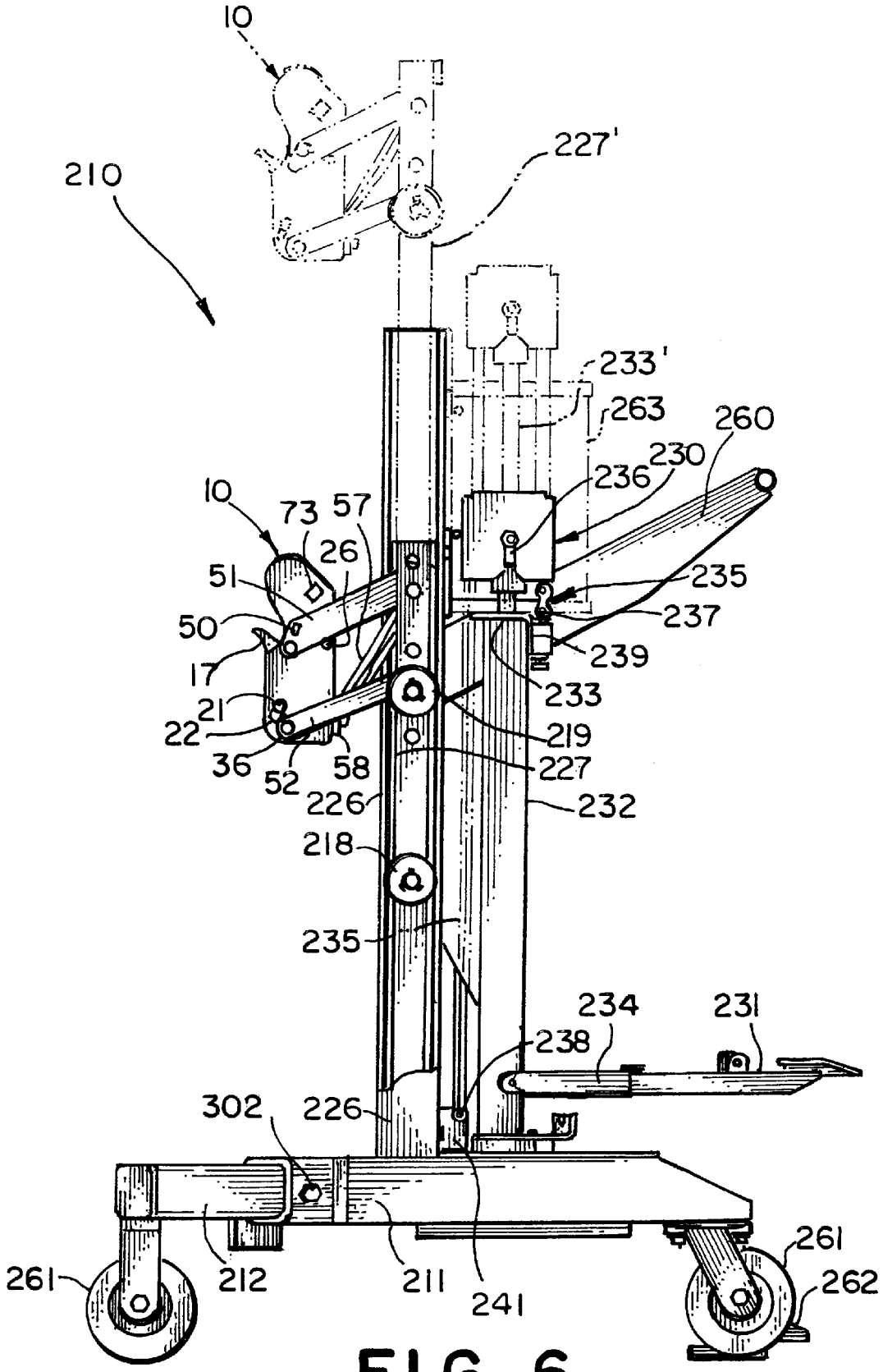
FIG. 6 is a right side elevation view of a second alternate embodiment of a drum handling device constructed in accordance with the present invention illustrated with a lifting and moving mechanism, the broken lines showing the movable post member and lifting piston in a raised position.
Figure 7:
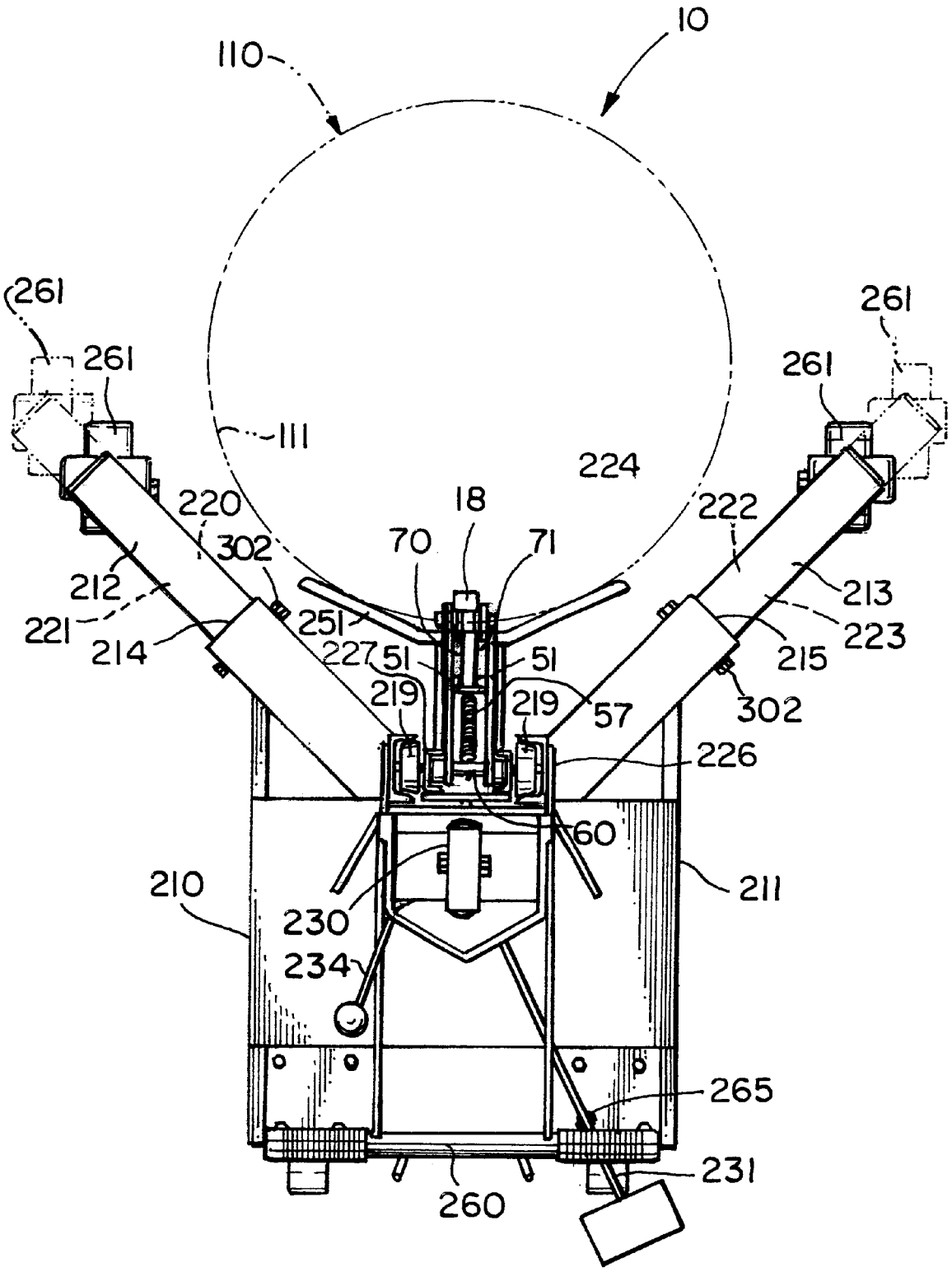
FIG. 7 is a top plan view of the second alternate embodiment of the drum handling device shown in FIG. 6, the broken lines showing the arm members in an extended position.

Referring to FIGS. 6 and 7, where like reference numerals in the drawings represent like components, an alternate embodiment of a drum handling device 210 is shown. The drum handling device 210 preferably engages a drum 110 and holds the drum 110 so that lifting and transport of the drum 110 can be accomplished. As shown in FIGS. 6 and 7, the device 210 comprises a frame 211, a first arm 212 projecting outwardly from the frame 211, and a second arm 213 projecting outwardly from the frame 211. The first arm 212 and second arm 213 project in different directions from the frame 211, as shown best in FIG. 7. The first arm 212 is carried in a first slot 214 of the frame 211 and is connected to the frame 211 with a fastening means, such as the bolt 302. The first arm 212 has a pair of oppositely disposed apertures (not shown) through which the bolt 302 extends to secure the first arm 212 to the frame slot 214. Likewise, the second arm 213 is carried in the second frame slot 215 and is secured thereto with a fastening member, such as a bolt 302.

The first arm 212 and second arm 213 preferably may be adjustably provided for positioning at a plurality of lengths with respect to the frame 211. For example, each of the first arm 212 and second arm 213 may be provided as a telescoping section which is received in a respective slot 214 and 215 of the frame 211. The first arm 212 and second arm 213 preferably can have adjustment means which is illustrated in a preferred embodiment to comprise a plurality of oppositely disposed apertures providing fastening locations at different positions along the first and second arms 212, 213 for securing the first and second arms 212, 213 to the frame 211. The extension of the first arm 212 and second arm 213 can be adjusted. As shown in FIG. 7, the first arm 212 and second arm 213 are adjustably configured to extend from the full-line position to an extended position represented by the broken-lines, with the oppositely disposed apertures 220, 221 of the first arm 212 and the oppositely disposed apertures 222, 223 of the second arm 213 being illustrated.

A space 224 is formed between the first arm 212 and the second arm 213 for accommodating a container, such as a drum 110, shown in phantom in FIG. 7. A post 226 is connected to the frame 211, and extends upwardly therefrom. A movable member 227 is supported on the post 226 and is selectively movable in relation to the post 226. The movable member 227 is shown in FIG. 6 telescoping from the post 226 from its initial position to a raised position, where the movable member is designated as 227'. Preferably, rollers 218, 219 are provided to facilitate travel of the movable member 227 along the post 226.

In FIGS. 6 and 7, the drum handling device 210 has a housing 11 which is linked to a movable member 227 with the upper frame links 51 and lower frame links 52. Connecting means for connecting the upper frame links 51 and lower frame links 52 with the movable member 227 are shown comprising connectors and connecting member 60 and a second connecting member 61, respectively. A first clamping member, shown comprising the paul 17 and a second clamping member, shown comprising hook 18 are mounted on the housing and are linked with clamping member linking means, such as the linking members 27 as described herein in connection with the embodiment shown in FIGS. 1–5.

Lifting means is provided for selectively raising the movable member 227 to one of a plurality of positions along the telescoping range of the movable member 227, as shown best in FIG. 6. The lifting means also permits the return of the movable member 227 from a raised position to a lower position. The lifting means can comprise a suitable lifting mechanism for selectively lifting the movable member 227 relative to the post 226. For example, in FIGS. 6 and 7, the lifting means is shown comprising a lifting mechanism 230 having a control element which controls the raising and lowering of the movable member 227. The control element can comprise any suitable actuator, such as for example, the levered foot pedal 231. The lifting mechanism 230 comprises a hydraulic cylinder 232 which is supported on the frame 211 and has a piston 233 which can be raised and lowered with the actuator 231. The actuator 231 controls the operation of the hydraulic cylinder 232 to raise and lower the movable member 227 via the piston 233. As shown in the broken-line view of FIG. 6, the piston 233' is raised. A hydraulic release 234 is provided to control the return of the raised piston 233' to a lower position. The hydraulic release 234 can be selectively actuated by the user. A chain 235 is provided to facilitate the lifting of the movable member 227. The chain 235 engages a sprocket wheel 236 which is carried by the piston 233. The chain 235 has a first chain end 237 which is secured to the hydraulic cylinder 232, with a suitable mounting means, such as for example, the fixed first bracket 239, and has a second chain end 238 which is secured to the movable member 227. Securing means for securing the second chain end 238 to the movable member 227 is shown comprising a second bracket 241 which is connected to the movable member 227 so that the second bracket 241 and movable member 227 move together when the piston 233 is raised or lowered. Preferably, a longitudinal slot (not shown) is provided in the post 226 so that the second bracket 241 can slide for vertical movement with the movable member 227.

Although the lifting means is shown comprising a lifting mechanism 230 with a hydraulic cylinder 232, it will be understood that other suitable lifting apparatus can be employed in accordance with the invention, alternately, or in addition to that shown. For example, chain, gear, compressed air, pulleys, electric lifting mechanisms, worm gears, screw type drives, and other suitable elements can be used to control the lifting of the movable member 227. The lifting means permits the raising and lowering of the movable member 227 with or without a drum 110 being carried on the device 210.

Preferably, the device 210 has a support member 251 for supporting the drum 110 and maintaining the drum 110 against movement, and in particular from preventing the drum 110 from moving into the post 226. The support member 251 is connected to the movable member 227 and moves therewith to provide support for the drum 110 when the drum 110 is being held by the device 210.

Moving means for facilitating moving of the device 210 is shown comprising a handle 260 connected to the frame 211. The handle facilitates moving the device 210 to a location where a drum is to be handled, as well as moving drums which are held with the device 210. Preferably, the frame 211 and the first and second arms 212, 213 are supported on wheels 261 which facilitate moving of the device 210. The device 210 preferably has a stop 262 to selectively secure the wheels 261 against movement to maintain the device 210 in a stationary position. A guard 263, shown in broken-line representation in FIG. 6, is preferably provided to cover lifting mechanism components. Preferably, a locking element 265 is provided to selectively lock the actuator 231 against further movement.

As shown in FIG. 6, the device 210 is illustrated in its open position ready to receive a drum 110. The upper frame links 51 engage the upper stops 73, 74 of the housing 11, and the release cams 50 are free from interference with the locking pins 43 of the hook 18. The lifting of a drum with the device 210 is accomplished by raising the piston 233 with the actuator 231 to move the pawl 17 into position to engage the drum rim 111. When the pawl 17 engages the drum rim 111, the further operation of the actuator 231 lifts the movable member 227 and the housing 11 connected thereto. The lifting of the housing 11 with the pawl 17 engaged on the drum rim 111 causes the linked hook 18 to pivot into a clamping position with the drum 110, as shown in FIG. 7. The locking pins 43 carried on the hook 18 are then cammed into the locking cam slots 50 to maintain the clamping of the hook 18 and pawl 17 on the drum 110, until selectively released. After the drum 110 is clamped, the further lifting of the movable member 227 and housing 11 connected thereto, lifts the drum 110.

The drum 110 is held on the device 210 until selectively released. The releasing of the drum 110 is accomplished by resting the drum 110 on a surface, or otherwise independently supporting the weight of the drum (such as with a hoist or other lifting or supporting device), and lowering the upper frame links 51 against the weight of the drum so that the posts 49 of the release cams 50 engage the locking pins 43 depressing the locking pins inwardly and thereby releasing the hook 18 from engagement with the drum 110.

Figure 8:
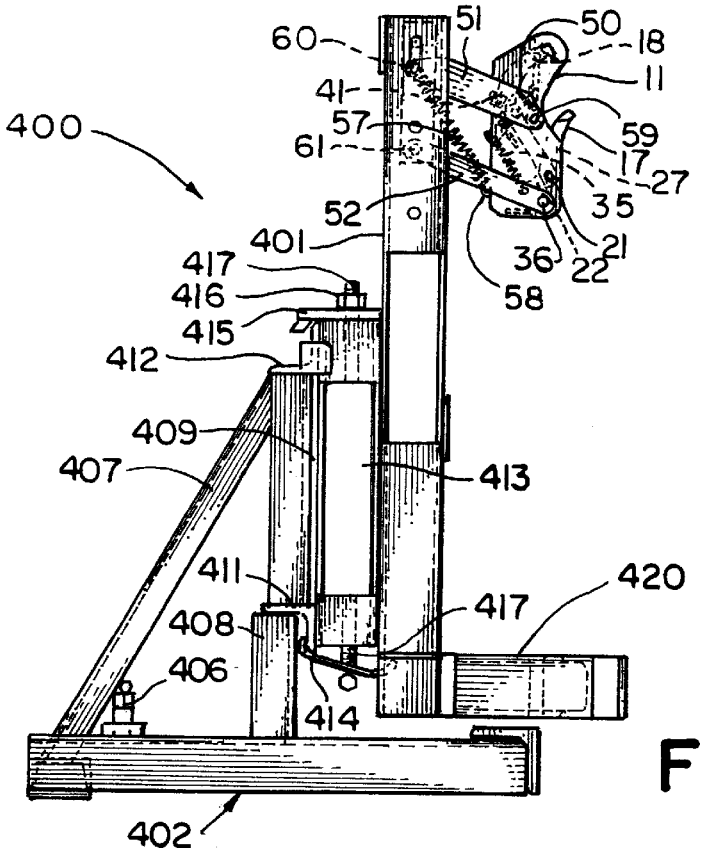
FIG. 8 is a left side elevation view of a third alternate embodiment of a drum handling device constructed in accordance with the present invention.
Figure 9:
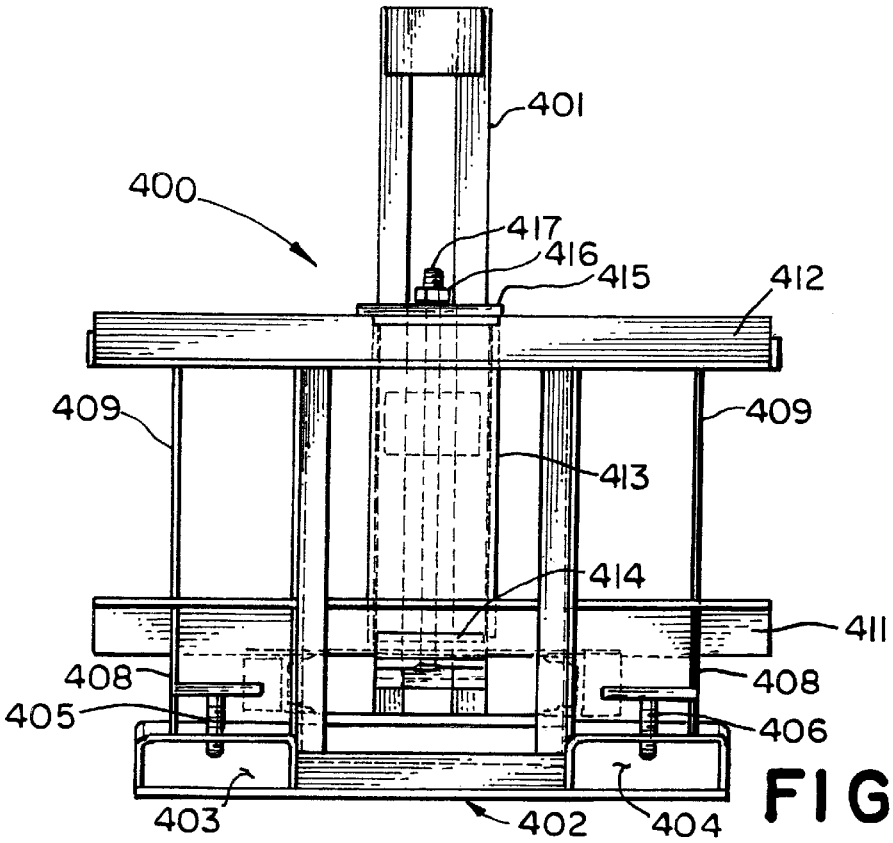
FIG. 9 is rear elevation view of the third alternate embodiment of the drum handling device shown in FIG. 8.
Figure 10:
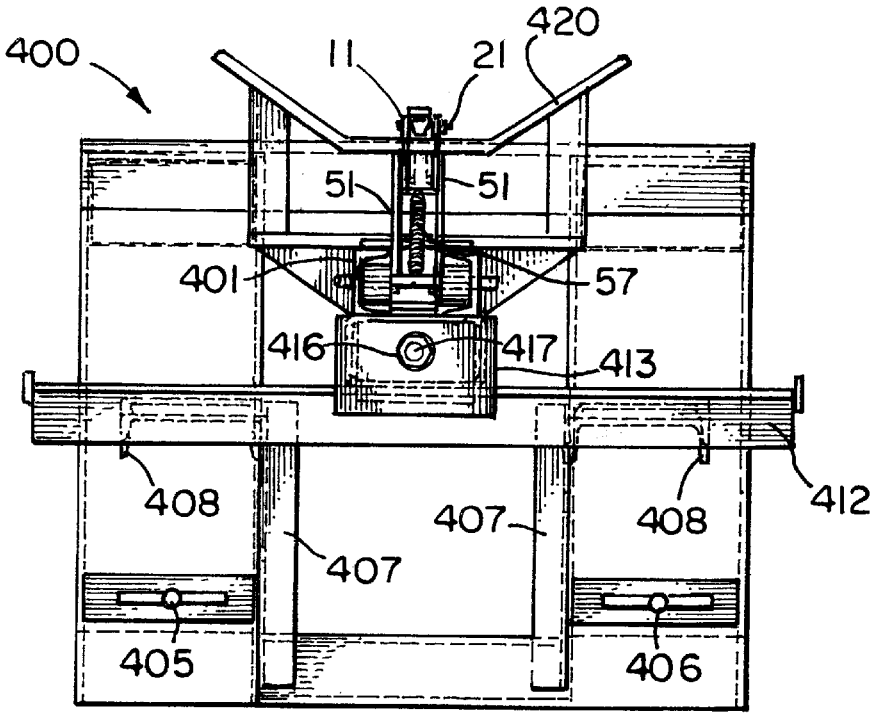
FIG. 10 is top plan view of the third alternate embodiment of the drum handling device shown in FIGS. 8 and 9.

Referring to FIGS. 8–10, where like reference numerals in the drawings represent like components, a third alternate embodiment of a drum handling device 400, constructed in accordance with the present invention, is illustrated. The drum handling device 400 comprises a housing 11 with a first clamping member, shown comprising the pawl 17 and a second clamping member, shown comprising the hook 18. The hook 18 and pawl 17 are linked with clamping member linking means, shown comprising the linking members 27 as described herein in connection with the embodiment shown in FIGS. 1–5. The housing 11 carries the components as discussed herein in connection with the embodiment shown in FIGS. 1–5, above.

The device 400 has a post member 401 which is supported on a frame 402. The frame 402 is detachably securable to a fork lift type truck, and has fork mounting spaces 403, 404 formed in the frame 402 for receiving the forks of a fork lift type truck or vehicle therein. Additional retaining members are preferably provided and can comprise retaining pins 405, 406 carried on the frame and disposed for connecting to the forks of a fork lift type truck. The frame 402 has a plurality of support members 407 and 408 which support a first bracket 411 and a second bracket 412. Preferably, connecting members 409 connect the first bracket 411 and second bracket 412.

The post 401 is connected to the frame 402 with the mounting member 413. The mounting member 413 has a first mounting flange 414 and a second mounting flange 415 to facilitate connection of the post 401 with the frame 402. A connecting member such as, for example, the threaded nut 416 is installed on a mounting shaft 417 to facilitate attachment and detachment of the post 401 on the frame 402. The first and second mounting flanges 414, 415 connect with the mounting brackets 411, 412 of the frame 402 to secure the mounting post 401 to the frame 402.

A support member 420 is provided for supporting a drum and maintaining the drum against movement when the drum is being handled with the device 400.

The device 400 has locking means for facilitating selective locking of the first clamping member, such as the pawl 17, and second clamping member, such as the hook 18, so that these members remain in a clamping engagement with a drum when the device 400 is being moved with a fork lift type truck. The mounting post 401 is disposed at a height which, when the drum is lowered onto a supporting surface, will permit the release cam 50 to engage the locking pins 43 (described above) and depress them into the body of the hook 18, to thereby release the drum from the clamping engagement of the pawl 17 and hook 18.

Figure 11:
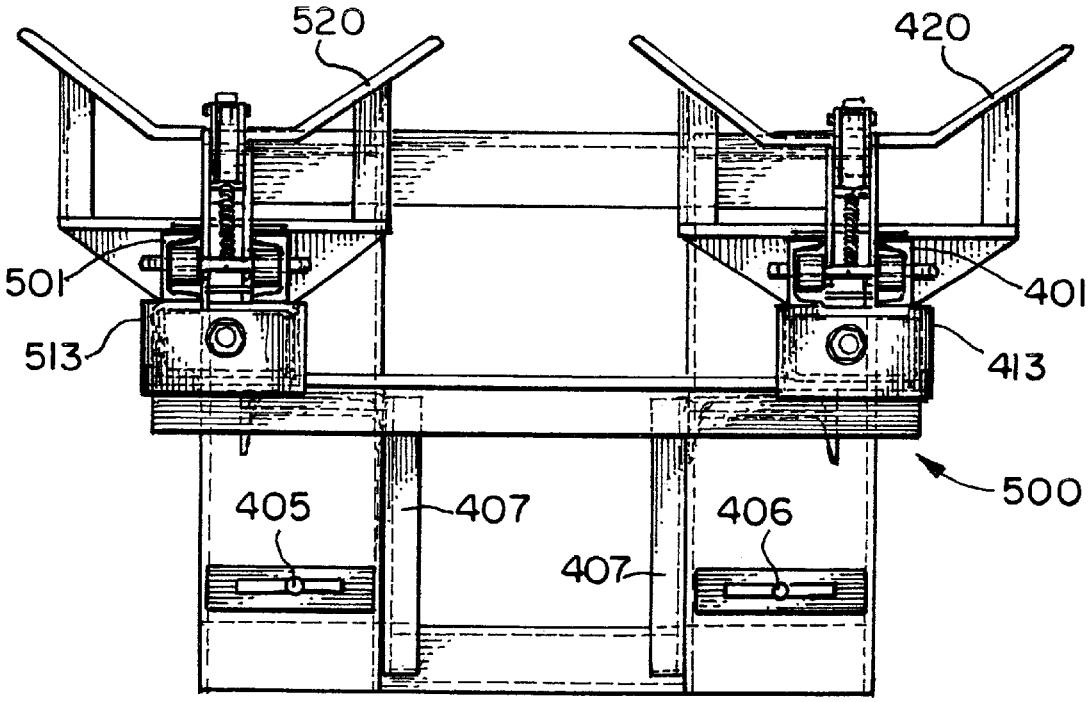
FIG. 11 is a top plan view of a fourth alternate embodiment of a drum handling device constructed in accordance with the present invention, shown supported on a carriage of a fork lift type truck.

Referring now to FIG. 11, where like reference numerals in the drawings represent like components, a fourth alternate embodiment of a drum handling device 500 constructed in accordance with the present invention is illustrated. The drum handling device 500 is constructed similar to the device 400 shown and described herein, but having a second mounting post 501 carried on the frame 402. The first mounting post 401 is spaced apart from the second mounting post 501 to facilitate the handling of two drums with the device 500. The second mounting post 501 preferably comprises a mounting post which is identical to the mounting post 401 described and shown herein. A mounting member 513, which is shown identical to the mounting member 413 is provided to facilitate the mounting of the second mounting post 501 to the frame 402, in the same manner described herein in connection with the first mounting post 401. A support member 520 is provided on the second mounting post 501.

Each the first mounting post 401, and the second mounting post 501 has a housing 11 connected thereto. Linking means are provided for connecting each housing 11 to a respective mounting post 401, 501 in the same manner as the linking means 51, 52 shown in FIGS. 8 and 9 connect the housing 11 to the first mounting post 401 of the device 400.

Figure 12:
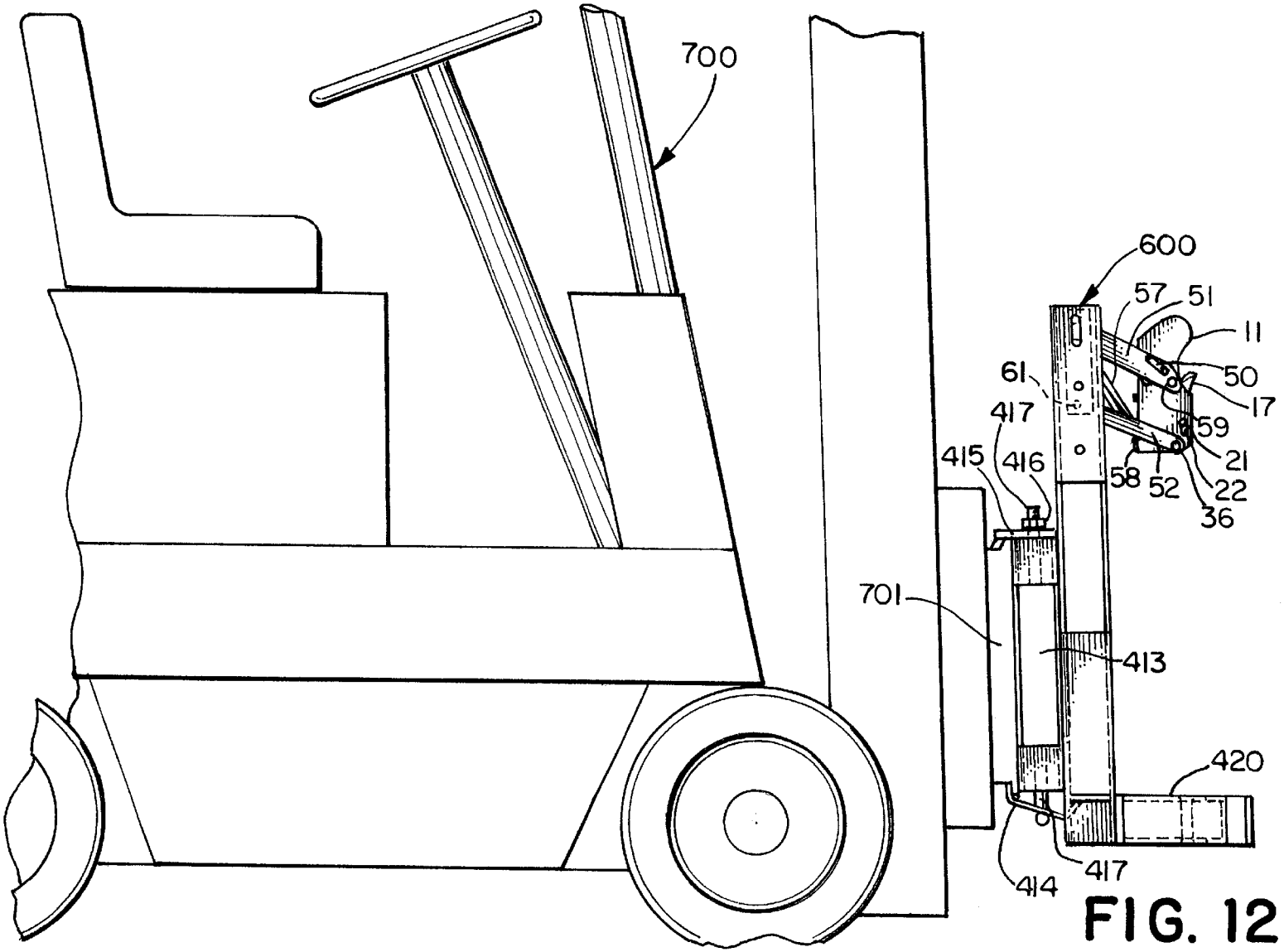
FIG. 12 is a right side elevation view of a fifth alternate embodiment of a drum handling device constructed in accordance with the present invention, shown supported on a carriage of a fork lift type truck.

Referring to FIG. 12, where like reference numerals in the drawings represent like components, there is illustrated a fifth alternate embodiment of a drum handling device 600 constructed in accordance with the present invention and shown in use with a fork lift type truck 700. The device 600 comprises a mounting post 401, a housing 11 which carries the clamping members 17, 18 and other components as described herein, and a mounting support member 413 having a first mounting flange 414 and a second mounting flange 415. The device 600 is constructed the same as the device 400, as shown and described herein, but without the frame 402. The device 600 is shown mounted to the carriage 701 of a fork lift type truck 700. The device 600 can be installed and removed as desired. The mounting member or fastening nut 417 can be tightened to secure the device 600 to the carriage 701, and untightened to release the device 600 from the carriage by permitting the release of the mounting flanges 414, 415. The carriage 701 is movable to be selectively lifted and lowered with the fork lift truck controls. The lifting of the carriage 701 can cause the clamping members 17, 18 to engage a drum rim as described herein.

While the invention is illustrated with the use of manual lifting apparatus and fork lift type trucks, it will be understood that other load supporting apparatus can be used within the spirit and scope of the invention. For example, the housing 11 of the device 10 can be linked with a pulley, hoist, pole or other member. Furthermore, while a single device 10 has been shown for use with handling a single drum, such as in FIG. 5, it will be understood that multiple devices 10 can be employed to lift a drum. For example, a load supporting member may carry two housings 11 which can provide clamping at two locations along the rim of a drum. Furthermore, while the housing 11 is shown connected to a post member at a particular location, it will be understood that the housing 11 can be positioned at various locations along the vertical height of the post member in order to accommodate the handling of different sizes of drums (e.g. drums having different heights). For example, where drums have been cut or relined, the drum height may change, requiring that the drum be lifted at a different height than its original height. In addition, it is possible that more than one device 10 may be installed at different vertical heights along a load supporting member, such as, for example a post, in order to facilitate the handling of multiple drums. These and other advantages of the present invention can be made consistent with the spirit and scope of the invention.

What is claimed is:

1. A drum handling device, comprising:

a) a housing;

b) a first clamping member pivotally mounted on said housing and being translatable relative to said housing;

c) a second clamping member pivotally mounted on said housing for pivotal movement relative to the housing;

d) clamping member linking means for linking the first clamping member with the second clamping member; and e) locking means for selectively releasably locking the second clamping member and first clamping member in engaging relation with a drum;

f) wherein said first clamping member and said second clamping member are adapted for clamping engagement with a drum, and wherein said locking means is adapted to engage to a locking position when said first clamping member and said second clamping member are in clamping engagement with a drum and disengage to an unlocking position when said drum is supported on a surface.

2. The device of claim 1, wherein said locking means comprises a locking member carried on the second clamping member which is adapted to engage the housing.

3. The device of claim 2, wherein said housing has a cam slot formed therein, wherein said locking member comprises a depressible pin carried by said second clamping member which is spring biased to translate outwardly from said second clamping member into a cam slot of the housing, and wherein the pin translates into the cam slot when the second clamping member is pivoted to a locking position where the housing cam slot is aligned with said pin.

4. The device of claim 1, wherein the first clamping member comprises a pawl.

5. The device of claim 4, wherein the second clamping member comprises a hook.

6. The device of claim 1, further comprising biasing means for biasing the first clamping member and the second clamping member into an open position.

7. The device of clam 4, further comprising a pawl stop for limiting the pivotal movement of the pawl.

8. The device of claim 2, wherein said locking means comprises a release cam for releasing the locking member from engagement with the housing.

9. The device of claim 1, further comprising housing linking means for linking the housing with a load supporting member.

10. The device of claim 9, wherein said housing linking means comprises a plurality of linking members.

11. The device of claim 10, wherein the plurality of linking members comprise a pair of upper frame links and a pair of lower frame links, wherein said upper frame links each have a first end and a second end, and wherein each said upper frame link is pivotally connected to the housing at a first end thereof and is pivotally connected to a load supporting member at the other end thereof.

12. The device of claim 11, wherein said locking means comprises a locking member carried on the second clamping member which is adapted to engage the housing, and a release cam for releasing the locking member from engagement with the housing, and wherein each said upper frame link carries a release cam.

13. A drum handling device, comprising a) a housing;

b) a first clamping member pivotally mounted on said housing and being translatable relative to said housing;

c) a second clamping member pivotally mounted on said housing for pivotal movement relative to the housing;

d) clamping member linking means for linking the first clamping member with the second clamping member; and e) locking means for selectively releasably locking the second clamping member and first clamping member in engaging relation with a drum f) wherein said housing has apertures, and wherein said locking means comprises pins movable with a clamping member for engagement with apertures on said ho sing.

14. A drum handling device, comprising:

a) a housing;

b) a first clamping member pivotally mounted on said housing and being translatable relative to said housing;

c) a second clamping member pivotally mounted on said housing for pivotal movement relative to the housing;

d) clamping member linking means for linking the first clamping member with the second clamping member; and e) locking means for selectively releasably locking the second clamping member and first clamping member in engaging relation with a drum;

f) wherein said locking means comprises a locking member carried on the second clamping member which is adapted to engage the housing.

15. A drum handling device, comprising:

a) a housing;

b) a first clamping member pivotally mounted on said housing and being translatable relative to said housing;

c) a second clamping member pivotally mounted on said housing for pivotal movement relative to the housing;

d) clamping member linking means for linking the first clamping member with the second clamping member; and e) locking means for selectively releasably locking the second clamping member and first clamping member in engaging relation with a drum;

f) housing linking means for linking the housing with a load supporting member;

g) wherein said housing linking means comprises a plurality of linking members;

h) wherein the plurality of linking members comprise a pair of upper frame links and a pair of lower frame links, wherein said upper frame links each have a first end and a second end, and wherein each said upper frame link is pivotally connected to the housing at a first end thereof and is pivotally connected to a load supporting member at the other end thereof;

i) wherein said locking means comprises a locking member carried on the second clamping member which is adapted to engage the housing, and a release cam for releasing the locking member from engagement with the housing, and wherein each said upper frame link carries a release cam.

* * * * *